United States Patent [19]

Ribich et al.

[11] 4,201,270

[45] May 6, 1980

[54] ROOF BOLTER

[75] Inventors: William A. Ribich, Lexington; Hans A. Hug, Weston; Alfred H. Bellows, Belmont, all of Mass.

[73] Assignee: Foster-Miller Associates, Inc., Waltham, Mass.

[21] Appl. No.: 906,237

[22] Filed: May 15, 1978

[51] Int. Cl.[2] ..... E21C 5/00

[52] U.S. Cl. ..... 173/43; 81/57.25; 81/57.41; 173/46; 173/52; 405/259; 405/303

[58] Field of Search ..... 29/26 A, 26 B; 81/57.25, 57.41; 173/43, 44, 46, 52; 175/219; 299/11, 12; 405/259, 303

[56] References Cited

U.S. PATENT DOCUMENTS

| | | | |
|---|---|---|---|
| 2,815,191 | 12/1957 | Beltz | 173/38 |
| 2,854,217 | 9/1958 | Benjamin | 173/44 X |
| 3,141,511 | 7/1964 | O'Leary | 173/52 X |
| 3,218,893 | 11/1965 | Madison et al. | 173/38 X |
| 3,246,705 | 4/1966 | Chappuis | 173/44 |
| 3,865,197 | 2/1975 | McCormick | 173/43 X |
| 4,050,259 | 9/1977 | Childress | 175/219 X |
| 4,057,115 | 11/1977 | Blanz | 173/160 |
| 4,085,492 | 4/1978 | Stange | 405/259 X |
| 4,108,253 | 8/1978 | Woodford | 175/219 X |
| 4,117,894 | 10/1978 | Saunders | 173/38 X |

*Primary Examiner*—Lawrence J. Staab

*Attorney, Agent, or Firm*—Morse, Altman, Oates & Bello

[57] ABSTRACT

An operator controlled roof bolter with a flexible shaft drill and a roof bolt inserter for drilling and inserting a roof bolt into an unsupported roof of a mine while the operator is positioned at an outby station under a supported roof. The flexible shaft roof drill is constrained to a frame of the roof bolter for pivoting movement between a rest position and a working position. The roof bolt inserter is mounted on a slide for linear movement and limited rotational movement between a retracted position and an extended position for positioning a roof bolt held by the inserter into registration with a hole drilled by the roof drill.

10 Claims, 4 Drawing Figures

ROOF BOLTER

BACKGROUND OF THE INVENTION

1. Field of the Invention

The present invention relates to the supporting of underground mine roofs and, more particularly, is directed towards an apparatus for drilling holes in the roof of a mine and for inserting roof bolts into such holes.

2. Description of the Prior Art

In underground mines, the roof is supported by roof bolts which are inserted into holes drilled into the roof strata. An apparatus for drilling holes having a depth substantially greater than the height of the mine passageway in which the apparatus is located is described in U.S. Pat. No. 4,057,115. An apparatus for inserting roof bolts into the drilled holes is described in U.S. Pat. No. 4,003,233.

Although progress has been made in roof bolting apparatus, roof bolting remains one of the most hazardous mining occupations for several reasons. The operator inserting the roof bolt is stationed inby at an area in which the roof is unsupported. It is the operator's task to drill and to insert roof bolts in this unsupported area. Consequently, the operator is exposed to the hazard of having sections of the unsupported roof fall on him. Mine personnel have been injured by flying objects from the exposed rotating drill steel and tools employed to tighten the roof bolts. Workers are also exposed to the risk of being caught on and pulled into the rotating portions of the mining apparatus.

Attempts to develop roof bolters which are capable of remotely installing bolts have been met with limited success even for the simplest case when the bolts are shorter than the height of the mine passageway. Such attempts have resulted in complex and costly systems which suffer from low reliability due to many moving parts and continual readjustment. A need has arisen for an improved roof bolting system which does not suffer from the heretofore mentioned disadvantages.

SUMMARY OF THE INVENTION

It is an object of the present invention to provide a roof bolting system which does not suffer from the heretofore mentioned disadvantages and limitations.

A further object of the invention is to provide a simple and reliable roof bolting system for remote drilling and insertion of roof bolts, particularly bolts that are longer than the height of the mine passage.

Another object of the invention is to provide a simple and reliable roof bolting system with an outby operator's station for remote drilling and insertion of roof bolts in which an inserter is moved rearwardly towards an operator for reception of the bolt rather than having the bolt fed forwardly to the inserter from the operator. Such a system includes a rugged mechanism for moving the inserter which is simpler and more reliable than bolt feed systems.

Yet another object of the invention is to provide an operator controlled roof bolter with a flexible shaft roof drill or other longer than seam height drill and a roof bolt inserter for drilling and inserting a roof bolt into an unsupported roof of a mine while the operator is outby and is positioned under a supported roof. The flexible shaft roof drill is mounted to a frame of the roof bolter and is constrained for pivoted movement between a rest position and a working position. The roof bolt inserter is configured to bend and feed roof bolts having a length that is greater than the height of the mine passageway. A head of the roof bolt inserter is mounted on a slide for linear movement and limited rotational movement between a retracted position and an extended position in order to align the advancing roof bolt with a hole drilled in the roof strata of the mine by the flexible shaft roof drill. In the retracted position, the inserter is in place to receive a roof bolt from an operator without requiring the operator to leave a supported or safe area. The hole is drilled when the roof drill is in its working position. Upon completion of the drilling step, the roof drill is pivoted to its rest position and the roof bolter inserter is moved to its extended position. A controller is provided for aligning the roof bolt and the drilled hole. A hydraulically actuated plate pushes the inserted roof bolt further into the drilled hole. A torquer engages the inserted roof bolt and tightens the roof bolt to effect the roof support.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
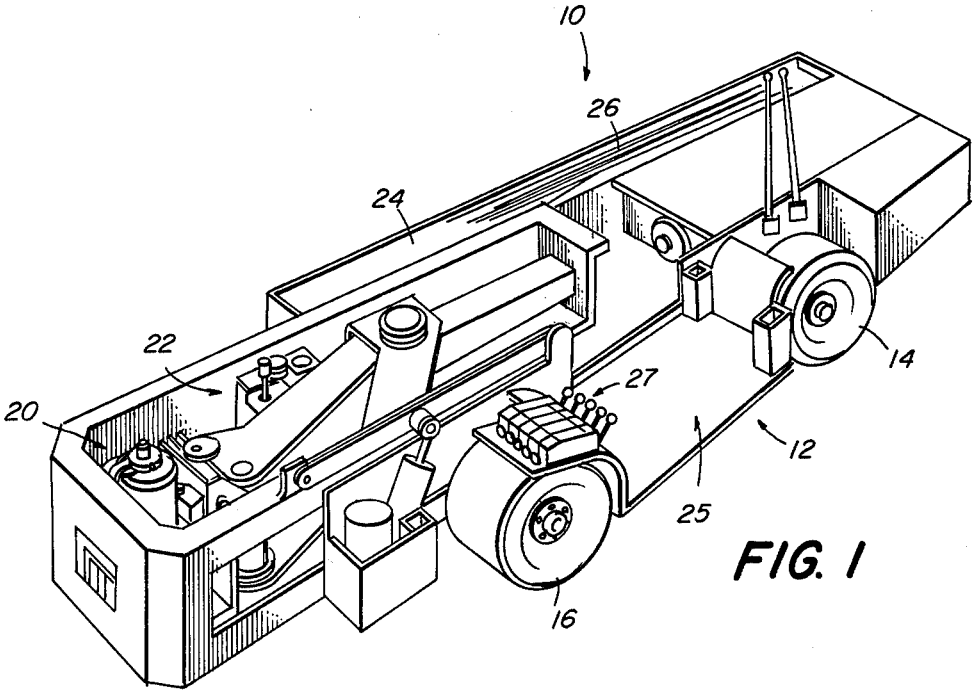
FIG. 1 is a perspective view of a roof bolter embodying the invention.
Figure 4:
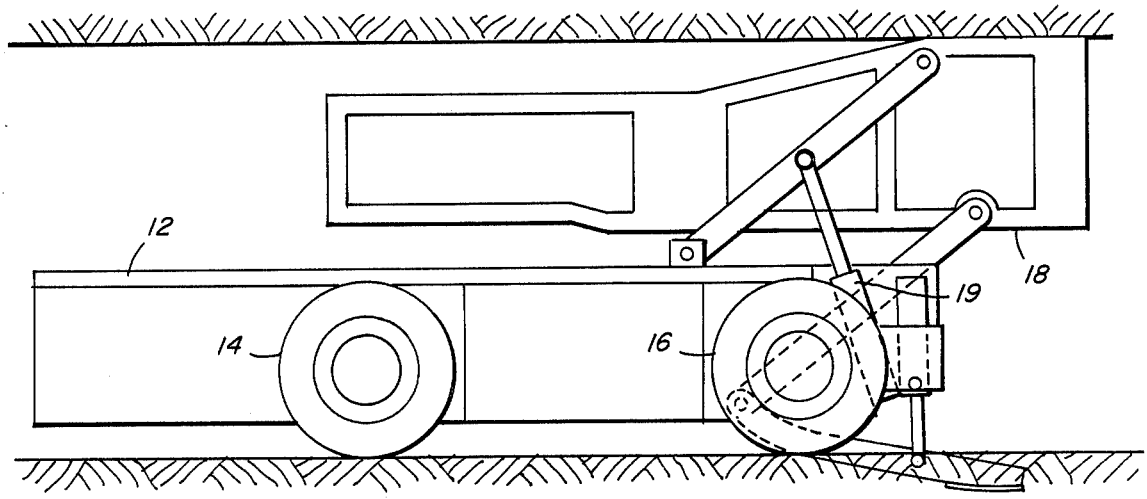
FIG. 4 is a side elevation of the roof bolter of FIG. 1 with the frame in its elevated position.

Referring now to the drawings, particularly FIG. 1, there is shown an operator controlled roof bolter system 10 embodying the present invention for drilling holes in the roof strata of mines and tunnels and for inserting roof bolts into the holes while the operator is outby and is positioned under a supported area of the roof. Roof bolter 10 is especially configured to insert roof bolts having a length which is longer than the mine or tunnel height. Roof bolter system 10 is provided with a mobile base 12 having a pair of rear wheels 14 and a pair of front wheels 16. A frame 18 is mounted to base 12 and carries a flexible shaft roof drill 20 and a roof bolt inserter 22 at the forward end of roof bolter system 10. An outby operator's station 25 is located towards the rear of roof bolter 10. Although not shown, preferably, operator's station 25 is provided with a protective canopy. A compartment 24 for storage for roof bolts 26 is provided at one side of roof bolter 10. As shown in FIG. 4, frame 18 is moved by an actuator 19, for example a hydraulic actuator, into an elevated position. The operator energizes actuator 19 and moves frame 18 into contact with the mine roof. Frame 18 remains in such contact during operation of the system and until the roof bolt is properly in place.

Flexible shaft roof drill 20 is mounted to frame 18 for pivotal movement and vertical movement between a rest position and a working position. Roof bolt inserter 22 is mounted to frame 18 for linear movement and rotational movement between a retracted position and an extended position. As hereinafter described, flexible shaft roof drill 20 is pivoted into its working position and moved upwardly through frame 18 towards the roof strata for drilling of a hole. Upward movement of flexible shaft roof drill 20 provides additional freedom to avoid roof irregularities which could impede movement of the flexible drill. However, it is to be understood that such upward movement is not absolutely required for operation of roof bolter system 10. As the hole is being drilled, a roof bolt is placed in roof bolter inserter 22, which is in its retracted position relatively close to the operator. Upon completion of the drilling operation, flexible shaft roof drill 20 is moved to its rest position and roof bolt inserter 22 is slidably moved into its extended position. Roof bolt inserter 22 is positioned by the operator with a joy stick type controller 27 until the roof bolt is in registration with the drilled hole. The roof bolt is inserted into the drilled hole and tightened therein. Upon completion of the insertion step, roof bolt inserter 22 is returned to its retracted position.

Figure 2:
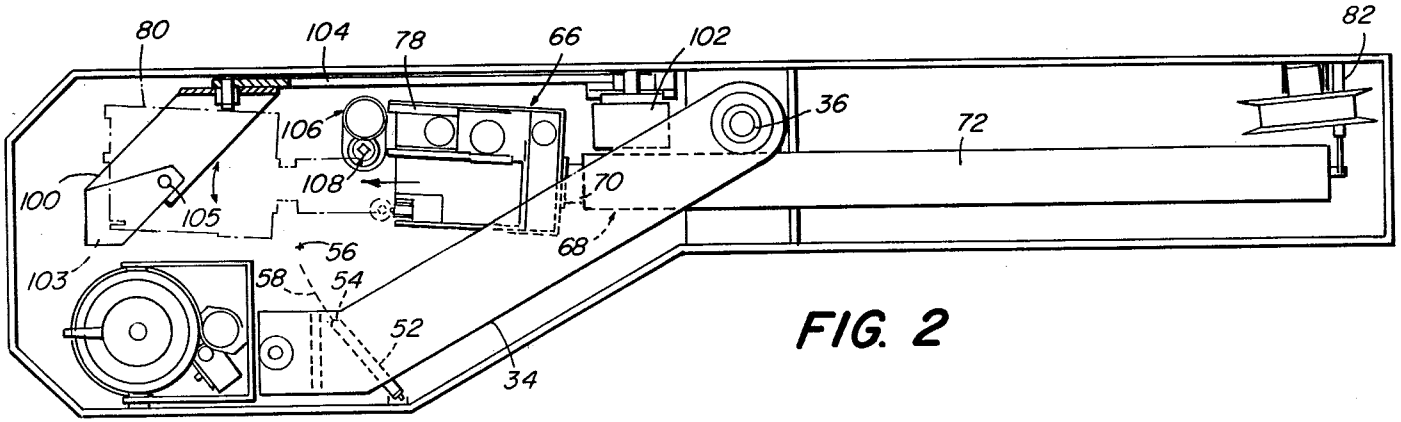
FIG. 2 is a top plan view of the frame of the roof bolter of FIG. 1.
Figure 3:
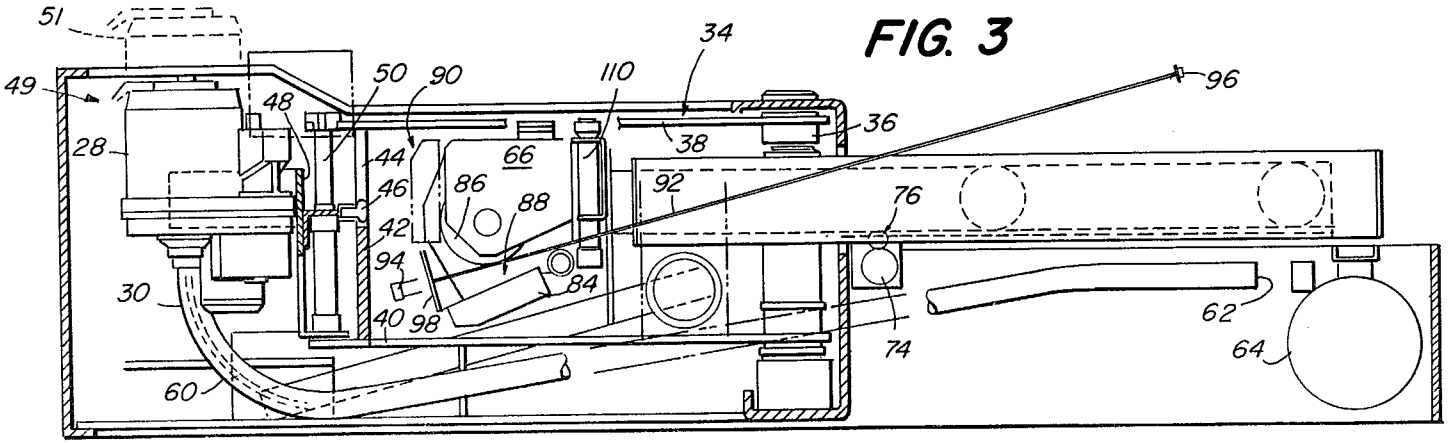
FIG. 3 is a side elevation of the frame of the roof bolter of FIG. 1.

Referring now to the specific structure of roof bolter 10 shown in FIGS. 2 and 3, it will be seen that flexible shaft roof drill 20 includes a head 28 for holding and for driving a flexible shaft 30. Head 28 is connected to an arm 34 which is pivotally mounted to a post 36, arm 34 having parallel upper and lower members 38 and 40. A cross member 42 having a track 44 is connected between upper arm member 38 and lower arm member 40. A cam follower 46, which is slidably received within track 44, is connected to a bracket 48 that is mounted to head 28. An actuator 50, for example a hydraulic actuator, connected to upper arm member 38 engages a bracket 48 for vertically moving head 28, cam follower 46 following track 44. The relative vertical movement of head 28 is shown by the solid lines at 49 and dashed lines 51 in FIG. 3. An actuator 52, for example a hydraulic actuator, connected between upper arm 38 and frame 18 is operative to move head 28 between a rest position and a working position. As best shown in FIG. 2, the rest position and working position are denoted by the reference characters 54 and 56, respectively, which represent the movement of actuator 52, the arcuate travel path of the actuator indicated by the dashed line 58. From the foregoing, it will be readily appreciated that arm 34 carries head 28 and is pivotally movable between a rest position and a working position by actuator 52, and head 28 is vertically movable relative to arm 34 by actuator 50. A hole is drilled in the roof strata by the working end of flexible shaft 30 when head 28 is moved to its working position, the flexible shaft advancing upwardly as the hole is drilled. Upon completion of the drilling operation, flexible shaft 30 is withdrawn and head 28 returns to the rest position.

Flexible shaft 30, which is held in head 28, is received within an annular guide 60 that is mounted to a lower portion of head 28. Annular guide 60 is configured to receive and to protect flexible shaft 30. Flexible shaft 30 is free to rotate and to move along its axis within annular guide 60. A flexible hose (not shown) is connected to the free end of flexible shaft by a swivel (not shown) and leaves end 62 of annular guide 60 and is wound on a reel 64. The other end of the hose is connected to a vacuum source or air supply (not shown) for removing material about the working or drilling end of flexible shaft 30.

Roof bolt inserter 22 includes a working head 66 which is carried on a slide 68 having an inner arm 70 and an outer arm 72, working head 66 being mounted to inner arm 70. Outer arm 72 is pivotally mounted to post 36, arm 34 of roof drill and outer arm 72 of roof bolt inserter 22 being independently movable on post 36. An actuator 74, for example a hydraulic motor, is drivingly connected to a rack and pinion assembly 76 for slidably moving inner arm 70 relative to outer arm 72. Inner arm 70 is slidably movable between a retracted position and an extended position as indicated in FIG. 2 by the solid and dashed lines at 78 and 80, respectively. An actuator 82, for example a hydraulic actuator, is connected between frame 18 and outer arm 72 for laterally moving working head 66.

As best shown in FIG. 3, working head 66 includes a bending arm 84 which is constrained for eccentric movement towards and away from a wheel 86 between a rest position at 88 and a feeding position at 90. Roof bolt 26 is inserted between bending arm 84 and wheel 86 when in the rest position. In the illustrated embodiment, by way of example, roof bolt 26 includes a rod 92 having an expansion shell or anchor 94 at one end, a tightening head 96 at the other end and a slidable plate 98 adjacent to shell 94. In an alternative embodiment, a resin grouted roof bolt is inserted by roof bolt inserter 22. As viewed in FIG. 3, roof bolt 26 is positioned between bending arm 84 and wheel 86, plate 98 and shell 94 being forward of the bending arm. An actuator (not shown) moves bending arm 84 from the rest position 88 to the feeding position 90. In consequence, the marginal section of rod 92 is bent from a generally horizontal orientation to a substantially vertical orientation. Thereafter, rod 92 is fed forwardly and upwardly from a generally horizontal orientation to a substantially vertical orientation as it is advanced by working head 66. As previously indicated, upon completion of the drilling operation, flexible shaft roof drill 20 returns to its rest position. Thereafter, roof bolt inserter 22 is moved to its extended position. If necessary, hydraulic actuator 82 is energized for laterally moving working head 66 so that expansion shell 94 is aligned with the hole drilled in the roof strata. Then, roof bolt 26 is inserted into the drilled hole. As roof bolt 26 is fed into the drilled hole, rod 92 passes through plate 98 and head 96 moves toward plate 98. Upon completion of the feeding step, bending arm 84 is moved to its rest position and roof bolt 26 is released. Typically, head 96 is fifteen to twenty inches below the roof, roof bolt 26 is frictionally held within the drilled hole and plate 98 is held on rod 92 by head 96. Roof bolt inserter 22 returns to its retracted position and is ready to receive another roof bolt 26.

Roof bolt 26 is pushed into the drilled hole by a plate 100 which is driven by an actuator 102, for example a rotary hydraulic actuator that is mounted to frame 18. Plate 100 is mounted to one end of an arm 104 and actuator 102 is connected to the other end of arm 104. In the illustrated embodiment, end 103 of plate 100 is spring hinged at point 105 so that end 103 can be moved out of the way when flexible shaft roof drill 20 is in its working position. While plate 100 is pushing roof bolt 26 into the drilled hole, a roof bolt torquer 106 is indexed to properly engage head 96 with a socket 108. Roof bolt torquer 106 is mounted on working head 66 of roof bolt inserter 22. After roof bolt 26 is pushed into the drilled hole by plate 100, working head 66 is moved to its extended position so that the socket 108 is aligned with the head 96. An actuator 110, for example a hydraulic actuator, elevates wrench socket 108 for engagement with head 96 and tightens roof bolt 26 to its predetermined torque. Working head 66 of roof bolt inserter is returned to its retracted position. Roof bolter 10 is now ready for drilling and inserting another roof bolt 26.

From the foregoing it will be appreciated that the present invention provides an operator controlled roof bolting system for remote drilling and remote insertion of roof bolts while the operator is outby in a safe area. The illustrated flexible shaft drilling apparatus could be replaced by a longer than seam height drilling unit which automatically assembles short drill sections. Also, the roof bolting system could include single drill and inserter apparatus or multiple units on a variety of chassis.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An operator controlled roof bolting system for drilling holes in the roof strata of a mine and for inserting roof bolts into the drilled holes while the operator is in a safe area, said system comprising:

(a) a frame with an outby operator's station;

(b) roof drill means for drilling a hole in the roof strata, said roof drill means mounted to said frame for pivotal movement about an axis between a rest position and a working position;

(c) first means operatively connected to said roof drill means and said frame for pivotally moving said roof drill means about said axis between said rest position and said working position:

(d) roof bolt inserter means for inserting a roof bolt into a hole drilled in the roof strata by said roof drill means, said roof bolt inserter means mounted to said frame for movement between a retracted position and an extended position, said roof bolt inserter means including slide means mounted to said frame for pivoting movement about said axis; and (e) second means operatively connected to said roof bolt inserter means and said frame for moving said roof bolt inserter means between said retracted position and said extended position, said roof bolt inserter means proximate to said operator's station when in said retracted position, whereby the operator can place a roof bolt in said roof bolt inserter means while remaining at said operator's station.

2. The system as claimed in claim 1 wherein said roof drill means is a flexible shaft roof drill.

3. The system as claimed in claim 1, wherein said roof drill means is a longer-than-seam height drill.

4. The system as claimed in claim 1 wherein said roof bolt inserter means includes a working head mounted to said slide means, said slide means pivotally mounted to said frame, third means operatively connected to said slide means and said frame for pivotally moving said slide means about said axis.

5. The system as claimed in claim 1, including a plate for pushing a roof bolt inserted into the drilled hole and plate means for moving said plate into engagement with the roof bolt, said plate means connected to said frame and said plate.

6. An operator controlled roof bolting system for drilling holes in the roof strata of a mine and for installing roof bolts into the drilled holes while the operator is in a safe or supported area, said system comprising:

(a) a frame;

(b) roof drill means for drilling a hole in the roof strata, said roof drill means configured to drill a hole having a depth which is greater than the height of the mine, said roof drill means mounted to said frame for pivoting movement about an axis between a rest position and a working position;

(c) first actuator means operatively connected to said roof drill means and said frame for pivotally moving said roof drill means about said axis;

(d) roof bolt inserter means for inserting a roof bolt into a hole drilled in the roof strata by said roof drill means, said roof bolt inserter means including slide means and a working head, said slide means mounted to said frame for pivoting movement about said axis, said slide means linearly movable between a retracted position and an extended position, said working head carried by said slide means and linearly movable between said retracted position and said extended position, said working head configured to insert a roof bolt having a length which is no longer than the height of the mine into a hole drilled by said roof drill means, said drill means and said roof bolt inserter means independently movable about said axis;

(e) second actuator means operatively connected to said slide means for linearly moving said slide means between said retracted position and said extended position;

(f) third actuator means operatively connected to said slide means and said frame for pivotally moving said working head about said axis;

(g) said roof bolt inserter proximate to said operator's station when in said retracted position, whereby the operator can place a roof bolt in said roof bolt inserter while remaining at said operator's station.

7. The system as claimed in claim 6 wherein said roof drill means includes a drill and an arm, said drill carried by said arm, fourth actuator means operatively connected to said drill and said arm for moving said drill relative to said arm, said drill constrained for substantially vertical movement relative to said arm, said arm pivotally mounted to said frame for movement about said axis.

8. The system as claimed in claim 7 including torquer means mounted to said working head, said torquer means configured to engage the inserted roof bolt and to tighten the roof bolt to a perdetermined torque.

9. An operator controlled roof bolting system for drilling holes in the roof strata of a mine and for inserting roof bolts into the drilled holes while the operator is in a safe area, said system comprising:

(a) a frame with an outby operator's station;

(b) roof drill means for drilling a hole in the roof strata, said roof drill means pivotally mounted to said frame for pivotal movement about a first axis between a rest position and a working position;

(c) first means operatively connected to said roof drill means and said frame for pivotally moving said roof drill means about said first axis between said rest position and said working position;

(d) roof bolt inserter means for inserting a roof bolt into a hole drilled in the roof strata by said roof drill means, said roof bolt inserter means slidably mounted to said frame for slidable movement between a retracted position and an extended position; said roof bolt inserter means including a working head and slide means, said slide means pivotally mounted to said frame;

(e) second means operatively connected to said roof bolt inserter means and said frame for slidably moving said roof bolt inserter means between said retracted position and said extended position; and (f) third means operatively connected to said slide means and said frame for pivotally moving said slide means about said first axis;

(g) said roof bolt inserter means proximate to said operator's station when in said retracted position, whereby the operator can place a roof bolt in said roof bolt inserter means while remaining at said operator's station.

10. An operator controlled roof bolting system for drilling holes in the roof strata of a mine and for inserting roof bolts into the drilled holes while the operator is in a safe area, said system comprising:

(a) a frame with an outby operator'station;

(b) a flexible shaft roof drill for drilling a hole in the roof strata, said roof drill mounted to said frame for movement between a rest position and a working position;

(c) first means operatively connected to said roof drill and said frame for moving said roof drill between said rest position and said working position;

(d) roof bolt inserter means for inserting a roof bolt into a hole drilled in the roof strata by said roof drill, said roof bolt inserter means mounted to said frame for movement between a retracted position and an extended position;

(e) second means operatively connected to said roof bolt inserter means and said frame for moving said roof bolt inserter means between said retracted position and said extended position, said roof bolt inserter means proximate to said operator's station when in said retracted position, whereby the operator can place a roof bolt in said roof bolt inserter means while remaining at said operator's station;

(f) third means mounted to said frame; and (g) a plate mounted to said third means, said plate configured to push a roof bolt inserted into the drilled hole, said third means moving said plate into engagement with the roof bolt.

* * * * *